US007040124B1

(12) United States Patent
Miller, III et al.

(10) Patent No.: US 7,040,124 B1
(45) Date of Patent: May 9, 2006

(54) COTTON JERSEY FABRIC CONSTRUCTION HAVING IMPROVED STRETCH CHARACTERISTICS

(75) Inventors: Robert A. Miller, III, New Ringgold, PA (US); Joseph D. Atkins, Clemmons, NC (US); Donald R. Rummel, Tamaqua, PA (US)

(73) Assignee: Sara Lee Corporation, Winston-Salem, NC (US)

( * ) Notice: Subject to any disclaimer, the term of this patent is extended or adjusted under 35 U.S.C. 154(b) by 337 days.

(21) Appl. No.: 10/377,432

(22) Filed: Feb. 28, 2003

(51) Int. Cl.
*D04B 23/06* (2006.01)

(52) U.S. Cl. ..... 66/202

(58) Field of Classification Search ..... 66/202, 66/169, 170, 171, 194, 196, 198; 442/304, 442/308, 312
See application file for complete search history.

(56) References Cited

U.S. PATENT DOCUMENTS

| | | | | | |
|---|---|---|---|---|---|
| 2,347,005 | A | * | 4/1944 | Smith, Jr. | 66/201 |
| 3,016,726 | A | | 1/1962 | Lawson | 66/177 |
| 3,250,095 | A | * | 5/1966 | Bird | 66/178 R |
| 3,299,486 | A | | 1/1967 | Meyers et al. | 28/76 |
| 3,673,820 | A | | 7/1972 | Sarmiento | 66/177 |
| RE27,886 | E | | 1/1974 | Johnson | 66/177 |
| 3,852,828 | A | | 12/1974 | Silverstein | 2/224 A |
| 3,971,234 | A | * | 7/1976 | Taylor | 66/200 |
| 4,064,712 | A | | 12/1977 | Sayre et al. | 66/192 |
| 4,213,312 | A | | 7/1980 | Safrit et al. | 66/177 |
| 4,341,095 | A | | 7/1982 | Poteat | 66/177 |
| 4,341,097 | A | * | 7/1982 | Cassidy et al. | 66/187 |
| 4,351,340 | A | | 9/1982 | McLeod | 128/288 |
| 4,397,161 | A | | 8/1983 | Chesebro, Jr. et al. | 66/178 A |
| 4,688,403 | A | | 8/1987 | Gajjar | 66/195 |
| 4,875,241 | A | | 10/1989 | Browder, Jr. et al. | 2/409 |
| 5,031,424 | A | | 7/1991 | Peleg et al. | 66/176 |
| 5,198,288 | A | | 3/1993 | Grunfeld | 428/253 |
| 5,312,667 | A | * | 5/1994 | Lumb et al. | 428/91 |
| 5,321,960 | A | * | 6/1994 | Whitt et al. | 66/182 |
| 5,398,346 | A | | 3/1995 | Feinberg et al. | 2/400 |
| 5,412,957 | A | | 5/1995 | Bradberry et al. | 66/178 A |
| 5,519,894 | A | | 5/1996 | Imboden et al. | 2/409 |
| 5,623,839 | A | | 4/1997 | Hoggarth et al. | 66/178 A |
| 5,687,587 | A | * | 11/1997 | Michel | 66/196 |
| 5,708,985 | A | * | 1/1998 | Ogden | 2/239 |
| 5,735,145 | A | | 4/1998 | Pernick | 66/196 |
| 5,855,123 | A | | 1/1999 | Albright | 66/177 |
| 5,931,023 | A | * | 8/1999 | Brach et al. | 66/136 |
| 6,093,491 | A | | 7/2000 | Dugan et al. | 428/397 |
| 6,119,491 | A | | 9/2000 | Pinelli | 66/177 |
| 6,151,927 | A | | 11/2000 | Owens et al. | 66/178 R |
| 6,164,092 | A | * | 12/2000 | Menaker | 66/170 |
| 6,173,589 | B1 | | 1/2001 | Hayes, Jr. et al. | 66/171 |
| 6,276,175 | B1 | | 8/2001 | Browder, Jr. | 66/171 |
| 6,401,497 | B1 | | 6/2002 | Nishiyama et al. | 66/172 E |
| 6,776,014 | B1 | * | 8/2004 | Laycock et al. | 66/198 |
| 2001/0054303 | A1 | | 12/2001 | Browder, Jr. | 66/171 |

* cited by examiner

*Primary Examiner*—Danny Worrell
(74) *Attorney, Agent, or Firm*—Womble Carlyle Sandridge & Rice, PLLC

(57) ABSTRACT

A knitted fabric constructed from cotton yarns and synthetic yarns of polyester. The fabric is knitted with courses of cotton yarns, with a polyester yarn knitted with at least every fourth course of cotton yarn.

53 Claims, 3 Drawing Sheets

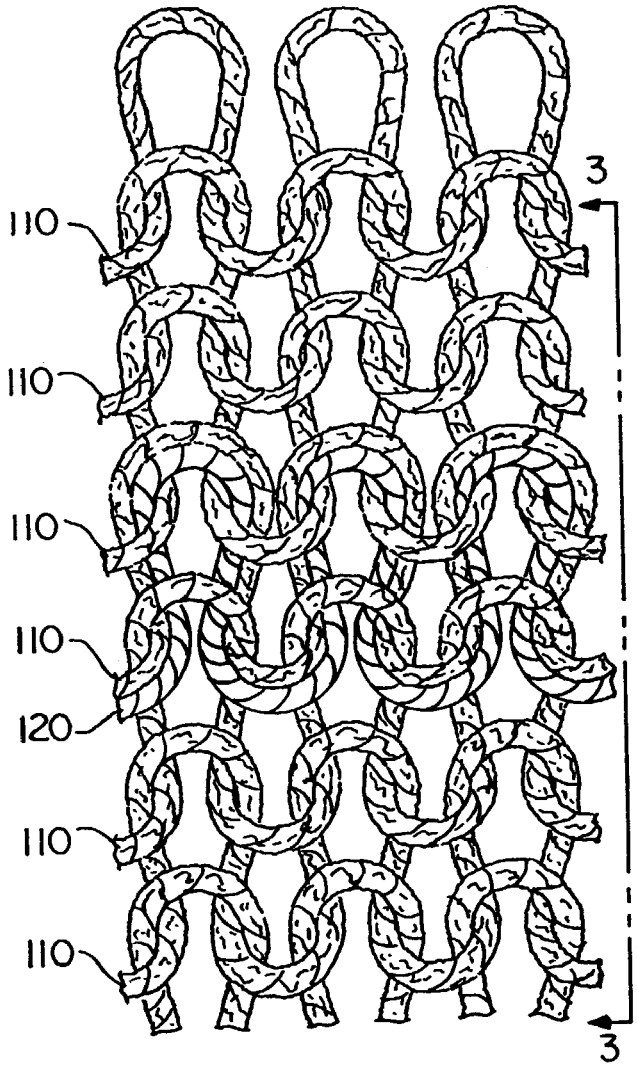
FIG. 2
FIG. 3
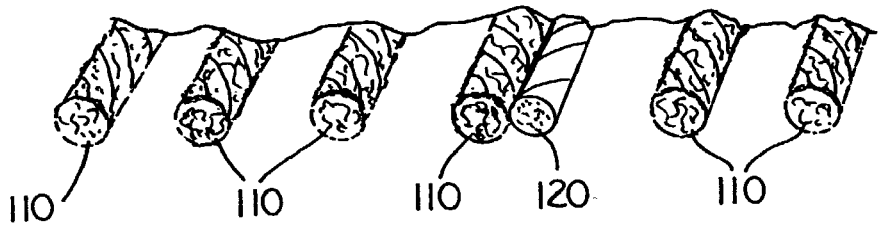

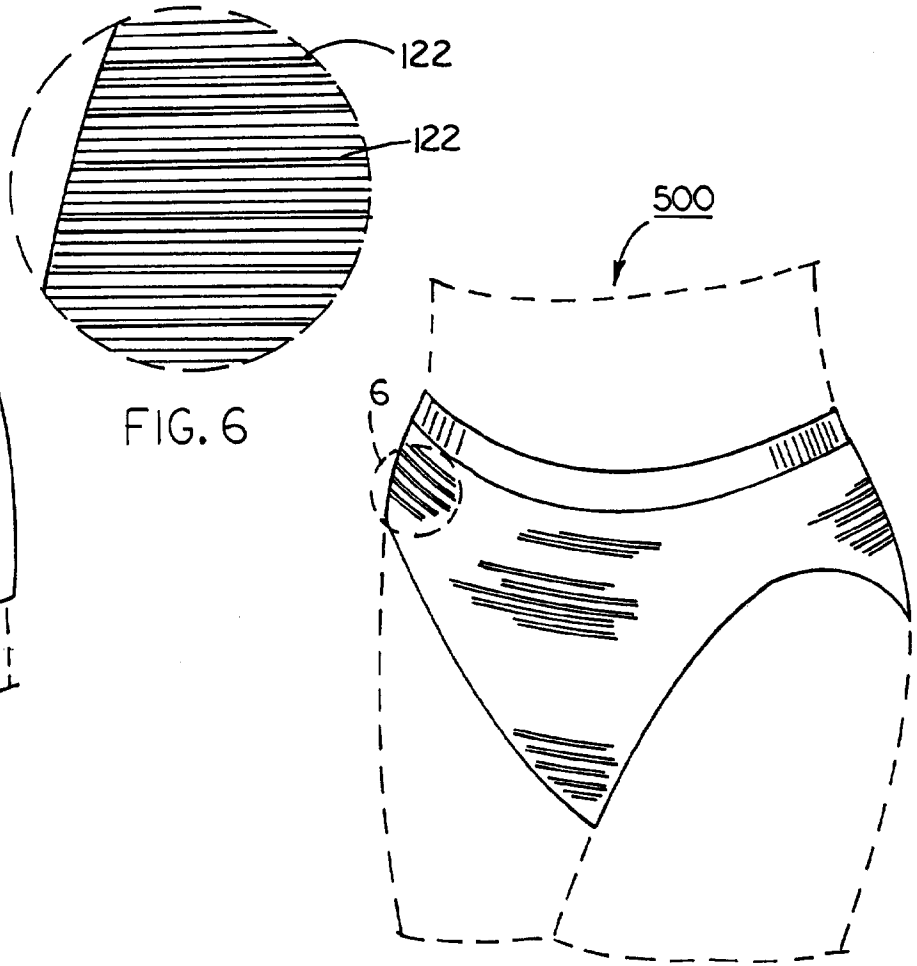
FIG. 5
FIG. 6
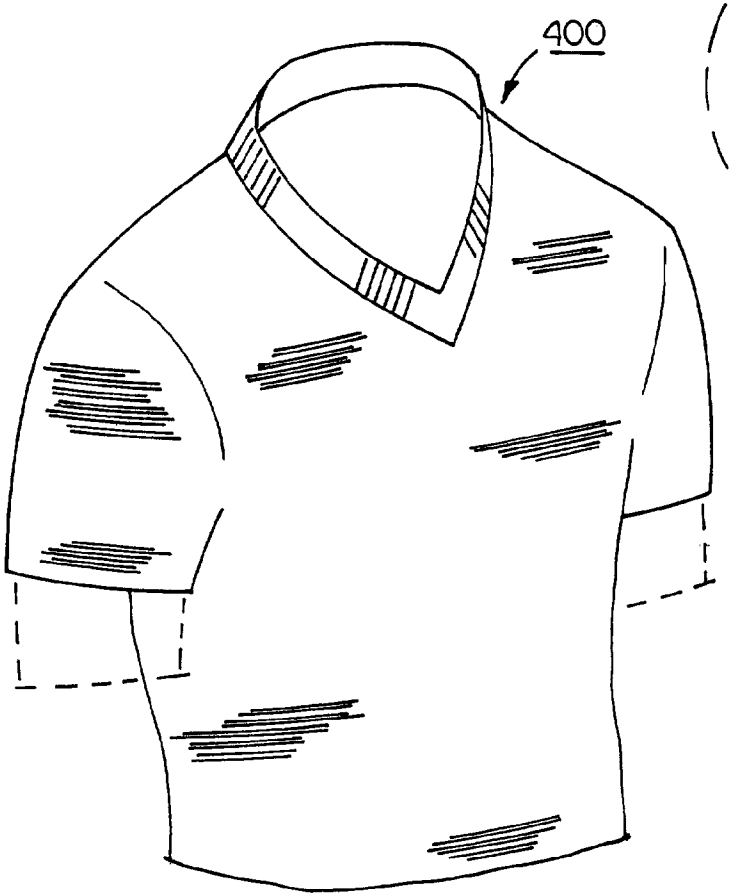
FIG. 4

COTTON JERSEY FABRIC CONSTRUCTION HAVING IMPROVED STRETCH CHARACTERISTICS

FIELD OF THE INVENTION

The present invention relates to the field of textile production, and, more particularly to a knitted jersey fabric construction, and apparel formed therefrom, having improved stretch characteristics.

BACKGROUND OF THE INVENTION

Consumers desire undergarments that are comfortable, but yet provide support at specific areas of the body, such as the hips and waist. Further, the undergarments should not be unsightly or bulky. It is particularly desirable to provide underwear, especially in the panty or crotch portion, with the soft feel and moisture absorbing characteristics of cotton.

In attempting to maximize each of these desired characteristics, apparel manufacturers have employed numerous different fabric constructions and designs. For example, one known predominantly polyester panty construction uses a yarn made from filamentary polyester that is knitted throughout. A cotton yarn is knit in plated relationship with the body yarn in every fourth course. While thought to provide sufficient comfort and moisture absorption, the spacing of the cotton yarn in every fourth course does not provide a sufficient quantity of cotton to provide the desired hand and moisture absorption of predominantly cotton constructions.

Another similar construction knits cotton in every fourth course, but the courses of cotton form stitch loops in spaced-apart wales and tucks therebetween to form free loops of cotton protruding inwardly toward the panty, or crotch, portion. While the inner face does include some of the feel and moisture absorbing characteristics of cotton, again, the knitting of every fourth course solely of cotton provides insufficient hand and absorption, and the stretchability of the underwear is restricted.

Various types of elastic combination yarns are also known, such as covered, core-spun, plied, core-effect, plaited, etc. Such yarns have been combined with non-elastic yarns to produce apparel with desirable stretch characteristics. It has been found, however, that the incorporation of these elastic combination yarns into fabrics often results in considerable area contraction in the fabrics immediately after they are removed from the knitting machine. Another disadvantage of elastic yarns is that they are relatively expensive.

Unfortunately, the problem still exists that garments, such as underwear, that are knit solely from natural fibers such as cotton and wool, without any elastic yarns in the fabric, suffer problems of shape distortion during subsequent finishing and wear, as well as the lack of desired support and stretchability.

SUMMARY OF THE INVENTION

One aspect of the present invention is directed to a knitted fabric, and apparel formed therefrom, having good stretch and support characteristics. More specifically, the knitted fabric is a jersey knit that is formed from a combination of natural and synthetic yarns. Jersey knit constructions are particularly suitable for apparel such as underwear, e.g., panties. Conventionally, "jersey" knit fabric is either a circular-knit or flat-knit fabric made with a plain stitch in which the loops intermesh in one direction only.

While the recent prior art has turned to panty constructions formed substantially from synthetic, and particularly polyester thermoplastic, materials, one preferred embodiment of the present invention provides a stretch jersey fabric that is formed substantially from cotton. The jersey fabric may be knitted on either a circular or flat knitting machine and is knitted with a selected number of courses of 100 percent cotton yarns. Desirably, each course comprises a single end of cotton yarn.

In at least every fourth course, a synthetic yarn of filamentary material is introduced in the same feed as the cotton yarn and knitted in parallel relation to the cotton yarn. The filamentary yarn is a polyester, which is not a conventional elastomeric yarn such as rubber, LYCRA® and SPANDEX™, which are normally employed to provide stretch characteristics. It has been found that certain polymers of polyester, such as polytrimethylene terephthalate (PTT) and polyethylene terephthalate (PET) have properties that make them suitable for the stretch jersey fabric of the present invention.

Yarns formed from the relatively low-cost polymers possess a soft hand consistent with the hand of ring spun cotton, yet are highly durable. Additionally, yarns formed from these materials possess quite suitable stretch characteristics. While known to have good stretch characteristics, it has not heretofore been known or recognized that yarns formed from these materials could be highly suitable substitutes for the more expensive conventional elastomeric materials, such as LYCRA® and SPANDEX™. Further, it has been found that yarns of PTT and PET can also be tensioned as they are fed to the knitting machine to obtain other specific stretch characteristics.

When the jersey fabric is constructed in accordance with the present invention, apparel formed therefrom possesses good stretch and retains its shape after being worn. By having a stretchable yarn in at least every fourth course, panties formed from the jersey fabric provide the desired level of support and feel to the wearer. Further, because at least every fourth course consists of both a cotton yarn and a polyester yarn, every fourth course creates a horizontal rib. The spaced ribs, i.e., every fourth course, provide both additional comfort and an aesthetically pleasing garment.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

BRIEF DESCRIPTION OF THE DRAWINGS

FIG. 2 is an enlarged perspective front view of the knitted fabric constructed in accordance with the present invention;

FIG. 3 is an enlarged sectional view of the knitted fabric of the present invention taken along Line 3—3 of FIG. 2;

FIGS. 4 and 5 are perspective views of garments constructed from the knitted fabric of the present invention; and FIG. 6 is an enlarged view of the ribbed pattern in the garments formed from the knitted fabric of the present invention.

DETAILED DESCRIPTION OF THE PREFERRED EMBODIMENTS

Figure 1:
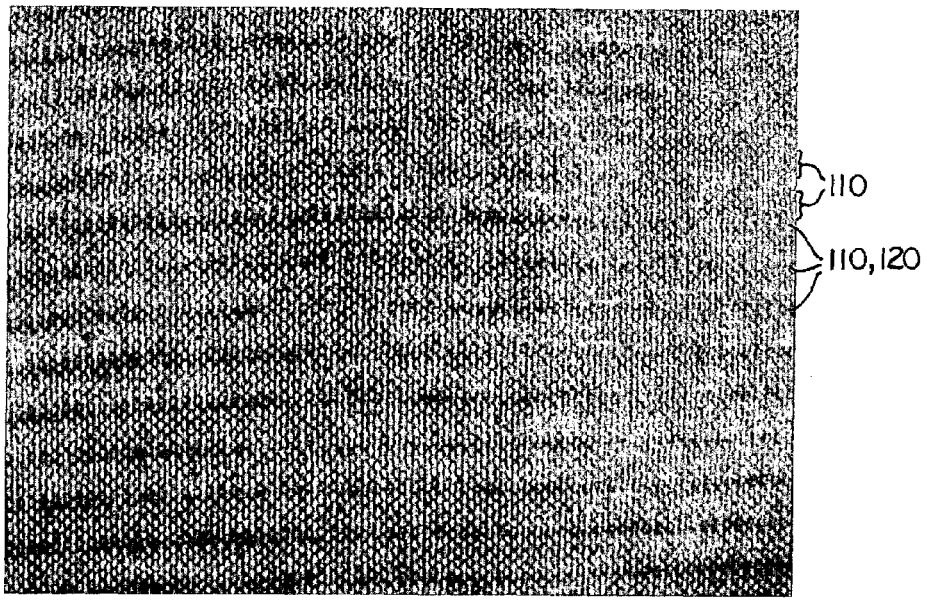
FIG. 1 is a front view of the knitted jersey fabric constructed according to the present invention.

As shown in FIG. 1, one aspect of the present invention is directed to a knitted fabric having improved stretch and support characteristics. Shown generally as 100, the fabric construction comprises both natural yarns 110 and synthetic yarns 120.

The knitted fabric is shown in greater detail in FIGS. 2 and 3. The fabric is knitted as a jersey knit that is formed substantially from 100 percent cotton yarns. In one preferred embodiment, the cotton yarns are each 36/1 combed, ring-spun, Z-twisted yarns. Since combing straightens fibers and extracts neps, foreign matter, and short fibers, a combed cotton yields a stronger, more even, more compact, finer, and smoother yarn. Ring spinning also results in a yarn having a substantially softer hand that yarns that are spun by other methods. Thus, the use of a combed, ringspun cotton yarn is desired where the fabric formed thereform is used in apparel such as underwear, and particularly, intimate apparel. The knitted fabric of the present invention is not, however, limited to combed, ringspun cotton yarns, as the improved stretch obtained in the knitted fabric described herein can be achieved with other cotton yarn constructions formed by other known spinning processes. Additionally, while one cotton yarn used herein is 36/1, the cotton yarn size is not limited thereto; rather, yarns ranging from about 40/1 to 18/1 will yield a knitted fabric having the desired stretch properties of the present invention.

If knitted from 100 percent cotton, the fabric would have a soft hand, but would lack stretch, support, and structure to prevent undesirable deformation of the apparel. Accordingly, a synthetic yarn of filamentary material is introduced in the same feed as the cotton yarn, for selected courses, and is knitted in generally a parallel relation to the cotton yarn. The filamentary material is desirably polyester, even though polyester is not conventionally known for having elastomeric properties. It has been found, however, that certain polymers of polyester, such as polytrimethylene terephthalate (PTT) and polyethylene terephthalate (PET) have properties that make either of them suitable for the knitted fabric described herein. For example, as a thermoplastic, PTT combines the best qualities of nylon and polyester. In addition to having a soft hand, synthetic filaments of PTT are stretchable. It has not heretofore been recognized that yarns formed from PTT filaments could be employed in apparel as a low-cost, durable, replacement for conventional, relatively expensive, elastomeric yarns and combination yarns.

Two suitable PTT yarns for the knitted fabric construction described herein are available under the trademarks CORTERRA®, available from O'Mara, Inc. of Spartanburg, S.C., and REFLEXX®, available from Unifi, Inc. of Greensboro, N.C. Both of these yarns comprise filaments that have one or more channels formed along their length for the capture and transport of moisture. Although polyesters are conventionally hydrophobic, the channels formed in the filaments of these yarns have been found to be highly effective pathways for the movement of moisture from an undesirable location in the fabric structure.

When knitted into a fabric construction with the 36/1 cotton yarn described hereinabove, either a 1/70/34 CORTERRA® filamentary yarn or a 1/70/48 REFLEXX® filamentary yarn is used. As will be appreciated by those skilled in the knitting arts, there are numerous combinations of cotton and filamentary yarns that can be used to form the knitted fabric. Desirably, however, the cotton and polyester yarns will have different weights per unit length to further enhance the channeling structure of the knitted fabric.

Although the filamentary yarns could be fed in with each course of cotton yarn, it has been found that the desired stretch of the fabric and apparel formed therefrom can be achieved if a filamentary yarn is fed in parallel relation to a cotton yarn in at least every fourth course. While not required, it has also been found that the tension of the filamentary yarn may be controlled to vary the desired stretch of the knitted fabric. The tension can be controlled by using a modified feeder conventionally used in connection with elastomeric yarns, such as LYCRA® yarn. Also, as described in greater detail below, the top and bottom tape settings may also control the feed and tension in the knitted yarns. As will be appreciated, the tension of the feed can be varied depending upon the percentage of stretch desired in the completed fabric, the construction of the knitted fabric, the composition of the yarns used, etc.

By way of example, the following are the knitting specification and setup parameters for one exemplary fabric construction:

EXAMPLE

A jersey fabric was knitted on a Monarch circular knitting machine, available from Monarch Knitting Machine Corporation of Monroe, N.C. The machine is set up with a 22 inch knitting head and knits at 40 rpm. The yarn feeds are end over end and comprise a 26/1 combed, ring spun, Z-twisted, 100 percent cotton yarn every feed, and a 1/70/34 filamentary polyester yarn (CORTERRA®) every fourth feed. The top and bottom tape settings are set at 181 inches per revolution, with a yarn tension of 6–7 grams, and a quality wheel setting of 135. This yields a knitted griege fabric having a weight of about 3.65 ounces per square yard, with 45 stitches per inch and a wale count of 30. A counter setting of 1,850 corresponds to a 32 pound roll of knitted fabric.

Depending upon the gauge of the knitting machine and the desired settings, a knitted jersey fabric formed in accordance with the method of the present invention yields a griege fabric having a weight of between about 3.5 ounces per square yard and 8 ounces per square yard, and a stitch density of between about 32 and 45.

Once the fabric has been knitted, the completed fabric may be subjected to finishing, conditioning, packaging, etc. The fabric is thereafter cut into patterns and formed into articles of apparel. Whereas one problem with knitted fabric constructions has been their inconsistent and unacceptably high levels and residual shrinkage, the knitted fabric constructed as described herein has unexpectedly been found to have a relatively low residual shrinkage. The term "residual shrinkage" refers to the amount of shrinkage, expressed in percent, which the finished fabric and/or article of apparel may still undergo when subjected to home laundering by the consumer and/or end user. Whereas residual shrinkage in many knitted articles of apparel exceeds 10 percent, the fabric and apparel of the present invention has been found to be less than about 5 percent. In one preferred embodiment, the residual shrinkage has been as low as 0.4 percent. For the apparel manufacturer, this means that pattern sizes for apparel may be reduced, resulting in reduced fabric costs.

FIGS. 4 and 5 are exemplary of articles of apparel that may be formed from the knitted fabric described above. FIG. 4 is exemplary of underwear, such as a T-shirt, outerwear, or activewear 400. FIG. 5 is exemplary of underwear, such as panties, or activewear 500.

As can be seen from FIGS. 1–3 and 6, the introduction of a filamentary yarn in at least every fourth course creates a plurality of ribs 122 that run parallel to the courses of the fabric. The ribbed pattern thereby created is considered to be aesthetically pleasing to some wearers.

As described above, the filamentary yarns are fed to the knitting machine under a controlled tension so that the resulting stretch characteristics meet or exceed the performance of conventional elastomeric yarns. For apparel such as panties, an elastic stretch and recovery of between about 20 percent and 50 percent is most desirable and is achieved when formed in accordance with the method of this invention.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A knitted fabric, comprising:

(a) a plurality of cotton yarns;

(b) a plurality of synthetic yarns; and (c) the cotton yarns primarily form the knitted fabric, at least some of the synthetic yarns are textured, and the plurality of cotton yarns and synthetic yarns are knitted in a plurality of courses, wherein a synthetic yarn is knitted therewith at least every fourth course of cotton yarn to form a knitted fabric having elasticity.

2. The knitted fabric of claim 1 wherein the cotton yarn is combed.

3. The knitted fabric of claim 1 wherein the cotton yarn is ring spun.

4. The knitted fabric of claim 1 wherein the cotton yarn is between about 40/1 and 18/1.

5. The knitted fabric of claim 1 wherein the cotton yarn is between about 130 denier and 300 denier.

6. The knitted fabric of claim 1 wherein the cotton yarn is a Z-twisted yarn.

7. The knitted fabric of claim 1 wherein the cotton yarn is an S-twisted yarn.

8. The knitted fabric of claim 5 wherein the polyester yarn is filamentary.

9. The knitted fabric of claim 8 wherein the filamentary yarn is between about 100 denier and 300 denier.

10. The knitted fabric of claim 5 wherein the polyester yarn is formed from a polymer selected from the group consisting of polytrimethylene terephthalate and polyethylene terephthalate.

11. The knitted fabric of claim 1 wherein the knitted fabric has a stitch density of between about 32 and 45 and a weight of between about 3 and 8 ounces per square yard.

12. The knitted fabric of claim 1 wherein the fabric has an elastic stretch and recovery of between about 20 and 50 percent.

13. The knitted fabric of claim 1 wherein the fabric is weft-knitted.

14. The knitted fabric of claim 1 wherein the fabric is a jersey knit.

15. The knitted fabric of claim 1 wherein the synthetic yarns create a rib in at least every fourth course, the knitted fabric comprising a plurality of spaced apart parallel ribs.

16. The knitted fabric of claim 1 wherein the knitted fabric has a residual shrinkage of less than about 5 percent.

17. An article of apparel formed from a knitted fabric, the knitted fabric comprising:

(a) a plurality of cotton yarns;

(b) a plurality of synthetic yarns; and (c) the cotton yarns primarily form the knitted fabric, at least some of the synthetic yarns are textured, and the plurality of cotton yarns and synthetic yarns are knitted in a plurality of courses, wherein a synthetic yarn is knitted therewith at least every fourth course of cotton yarn to form a knitted fabric having elasticity.

18. The article of apparel of claim 17 wherein the cotton yarn is combed.

19. The article of apparel of claim 17 wherein the cotton yarn is ring spun.

20. The article of apparel of claim 17 wherein the cotton yarn is between about 40/1 and 18/1.

21. The article of apparel of claim 17 wherein the cotton yarn is between about 130 denier and 300 denier.

22. The article of apparel of claim 17 wherein the cotton yarn is a Z-twisted yarn.

23. The article of apparel of claim 17 wherein the cotton yarn is an S-twisted yarn.

24. The apparel of claim 17 wherein the synthetic yarns are polyester.

25. The article of apparel of claim 24 wherein the polyester yarn is filamentary.

26. The article of apparel of claim 25 wherein the filamentary yarn is between about 100 denier and 300 denier.

27. The article of apparel of claim 24 wherein the polyester yarn is formed from a polymer selected from the group consisting of polytrimethylene terephthalate and polyethylene terephthalate.

28. The article of apparel of claim 17 wherein the knitted fabric has a stitch density of between about 32 and 45 and a weight of between about 3 and 8 ounces per square yard.

29. The article of apparel of claim 17 wherein the fabric has an elastic stretch and recovery of between about 20 and 50 percent.

30. The article of apparel of claim 17 wherein the fabric is weft-knitted.

31. The article of apparel of claim 17 wherein the fabric is a jersey knit.

32. The article of apparel of claim 17 wherein the synthetic yarns create a rib in at least every fourth course, the knitted fabric comprising a plurality of spaced apart parallel ribs.

33. The article of apparel of claim 17 wherein the apparel is underwear.

34. The article of apparel of claim 17 wherein the apparel is outerwear.

35. The article of apparel of claim 17 wherein the knitted fabric has a residual shrinkage of less than about 5 percent.

36. A method for forming a knitted fabric, comprising the steps of:

knitting courses of cotton yarns and synthetic yarns, the cotton yarns primarily forming the knitted fabric, and at least some of the synthetic yarns being textured; and knitting therewith at least every fourth course of cotton yarn a synthetic yarn to form a knitted fabric having elasticity.

37. The method of claim 36 wherein the cotton yarn is combed.

38. The method of claim 36 wherein the cotton yarn is ring spun.

39. The method of claim 36 wherein the cotton yarn is between about 40/1 and 18/1.

40. The method of claim 36 wherein the cotton yarn is between about 130 denier and 300 denier.

41. The method of claim 36 wherein the cotton yarn is a Z-twisted yarn.

42. The method of claim 36 wherein the cotton yarn is an S-twisted yarn.

43. The method of claim 36 wherein the synthetic yarns are polyester.

44. The method of claim 43 wherein the polyester yarn is filamentary.

45. The method of claim 44 wherein the filamentary yarn is between about 100 denier and 300 denier.

46. The method of claim 43 wherein the polyester yarn is formed from a polymer selected from the group consisting of polytrimethylene terephthalate and polyethylene terephthalate.

47. The method of claim 36 wherein the knitted fabric has a stitch density of between about 32 and 45 and a weight of between about 3 and 8 ounces per square yard.

48. The method of claim 36 wherein the fabric has an elastic stretch and recovery of between about 20 and 50 percent.

49. The method of claim 36 wherein the knitted fabric is weft-knitted.

50. The method of claim 36 wherein the fabric is a jersey knit.

51. The method of claim 36 wherein the synthetic yarns create a rib in at least every fourth course, the knitted fabric comprising a plurality of spaced apart parallel ribs.

52. The method of claim 36 wherein the knitted fabric has a residual shrinkage of less than about 5 percent.

53. The knitted fabric of claim 1 wherein the synthetic yarns are polyester.

* * * * *